United States Patent [19]

Brunnert

[11] Patent Number: 5,020,868

[45] Date of Patent: Jun. 4, 1991

[54] CLOSING DEVICE FOR A DRAWER ARRANGED IN A FURNITURE BODY

[75] Inventor: Eberhard Brunnert, Elchingen, Fed. Rep. of Germany

[73] Assignee: Julius Blum Gesellschaft m.b.H., Hochst, Austria

[21] Appl. No.: 454,506

[22] Filed: Dec. 21, 1989

[30] Foreign Application Priority Data

Jan. 2, 1989 [AT] Austria ..... A3/89

[51] Int. Cl.[5] ..... A47B 88/00; A47B 95/00

[52] U.S. Cl. ..... 312/319; 312/333; 16/80

[58] Field of Search ..... 16/78, 80, 71; 312/319, 312/333

[56] References Cited

U.S. PATENT DOCUMENTS 478,246 7/1892 Stoner ..... 16/71

2,064,926 12/1936 Kuebler ..... 312/319

FOREIGN PATENT DOCUMENTS 5718 12/1979 European Pat. Off. ..... 16/80

*Primary Examiner*—Richard K. Seidel

*Assistant Examiner*—Carmine Cuda

*Attorney, Agent, or Firm*—Wenderoth, Lind & Ponack

[57] ABSTRACT

On each side of a drawer is provided a pull-out rail fastened to the drawer and a supporting rail fastened to a furniture body side wall. A closing device pulls the drawer inwardly during a rearward portion of a push-in movement of the drawer into the body of the piece of furniture. The closing device includes a roller mounted on a pivotable lever which is acted upon by a spring. The roller is guided under pressure along a guide path that partly includes double tracks, the roller being guided in one track during an extracting motion and in the other track during the push-in motion.

41 Claims, 10 Drawing Sheets

CLOSING DEVICE FOR A DRAWER ARRANGED IN A FURNITURE BODY

FIELD AND BACKGROUND OF THE INVENTION

The present invention relates to a closing device for a drawer which is arranged in a body of a piece of furniture, wherein on each side of the drawer a pull-out rail is fastened to the drawer and a supporting rail is fastened to a side wall of the body. The closing device includes a pull-in assembly that pulls inwardly during a rearward portion of a push-in path of the drawer into the body. The pull-in assembly is formed by a roller or the like mounted on a pivotable lever which is acted upon by a spring and guided under pressure along a guiding path.

Modern drawers are provided with a pull-out guide assembly which comprises on each side of the drawer a supporting rail on the side of the body and a pull-out rail on the side of the drawer and which should render the displacement of the drawer as smooth as possible. For the transmission of the load of the drawer between the pull-out rail on the side of the drawer and the supporting rail on the side of the body there may be provided rollers, balls or slides, depending on the requirements the drawer has to fulfill with respect to smooth running and load capacity.

It has been found that a closed drawer sometimes may not be in its most rearward completely closed end position, and the front plate of the drawer may project from the furnture body. As a result, a person may bump against the drawer, and this may cause injury to the person or damage to the drawer. The front plate of the drawer will project from the front of the piece of furniture when the drawer has not fully and without care been pushed into the body of the piece of furniture. Even when the drawer has been pushed fully into the body of the piece of furniture but with too much energy, the drawer may again roll forwardly under the effect of such excess energy.

A closing device for a drawer is known from British Patent Specification 1,117,071 in which a pivot member is movable between two end positions. The pivot member is acted upon by a coil spring and is pressed into the respective end positions by the spring when a dead center position has been overcome. The pivot member is fastened to a furniture side wall. A side wall of a drawer has a driving pin which is moved into a notch in the pivot member in the end region of the path of movement of the drawer. Then, the driving pin presses the pivot member over the dead center, whereupon the pivot member itself pulls the driving pin and thus the drawer towards the rear.

Swiss Patent Specification 195,282 discloses a drawer with a pivot lever arranged at its rear. The pivot lever is guided with a roller in a curved guide path. The pivot lever serves firstly as a support of the extracted drawer and further for the complete closing of the drawer when the drawer has been closed without care by a user.

SUMMARY OF THE INVENTION

It is the object of the invention to provide a closing device which guarantees that a drawer is uniformly and safely pulled into a body of the piece of furniture, and wherein relatively little force is required for extraction of the drawer.

According to the invention, this object is achieved in that a roller is guided in a partly double-track guiding path, the roller being guided in one track when the drawer is being pulled out, and in the other track when the drawer is being pushed in. It is advantageously provided that the track used by the roller in the direction of insertion of the drawer comprises a steeper portion than the other track. Thus, the roller runs on a track with little inclination when the drawer is being opened and a spring is being tensioned, thus permitting opening of the drawer by a user with as little force as possible. To obtain during a closing movement that acceleration force necessary for an automatic closing or running-in of the drawer, the roller is caused to run on the track with the greater inclination during a rear portion of the closing movement by a lever, which is acted upon by the spring, and the roller pulls the drawer into the body and thus completely closes the drawer. The lever, spring and roller thus form a pull-in assembly of the closing device to automatically move the drawer to a fully closed position.

Further, it is advantageously provided that the steeper track has at the near thereof a portion with less inclination. By this arrangement, the mass of the drawer during the closing motion is accelerated during the last third of the closing path and the effect of inertia of such mass overcomes an unaccelerated residual portion of the path. On the one hand the range of automatic push-in of the drawer is increased by this arrangement, and on the other hand, by adapting the two track inclinations to the rolling and mounting friction as well as to the spring force, a harmonious inward motion of the drawer with very little closing noise can be obtained. Advantageously, a portion with less inclination adjoins the steeper portion, the two portions being inclined in opposite directions. Hence, the drawer is smoothly moved to received its rear position.

The present invention provides a closing device which is or may be independent of the pull-out guide assembly of the drawer. Drawers therefore optionally can be provided with the closing device according to the invention.

The closing assembly advantageously includes a roller which is guided at or in the guiding path. In principle, the use of slides also is possible. It has proved, however, that in most cases rollers are preferred because of less friction. One embodiment of the invention provides that the pull-in assembly includes a rolling body, preferably a cylinder, which is held in a vertical guiding of the drawer. It is advantageously provided that pull-in assembly is formed by a roller mounted on a pivotable lever. The lever may be a two-arm lever, with the roller being mounted at one arm and the spring action upon the other arm.

It is further advantageously provided that an elastic lip or member is arranged at least at one branching of the tracks of the running path. The guiding of the roller in the track can be improved by providing that the roller is acted upon by a spring in the direction of the axis of the roller and is pressed by such against the body side wall.

A further embodiment of the invention provides that the two tracks of the double-track guiding path are arranged at different levels. In this case, movable switching members or lips need not be provided. By a suitable design of junctions between the tracks the roller pressure on the guiding path in connection with the inclination of the track flanks in the region of a junction can be utilized for tracking the roller when the drawer is being extracted, and also for the constrained track guiding of the drawer when it is pushed in. In this embodiment no switching noise access and the absence of switching lips or members also reduces the occurrence of disorders.

BRIEF DESCRIPTION OF THE DRAWINGS

In the following various embodiments of the invention will be described in more detail with reference to the accompanying drawings, in which.

DESCRIPTION OF THE PREFERRED EMBODIMENTS

Figure 1:
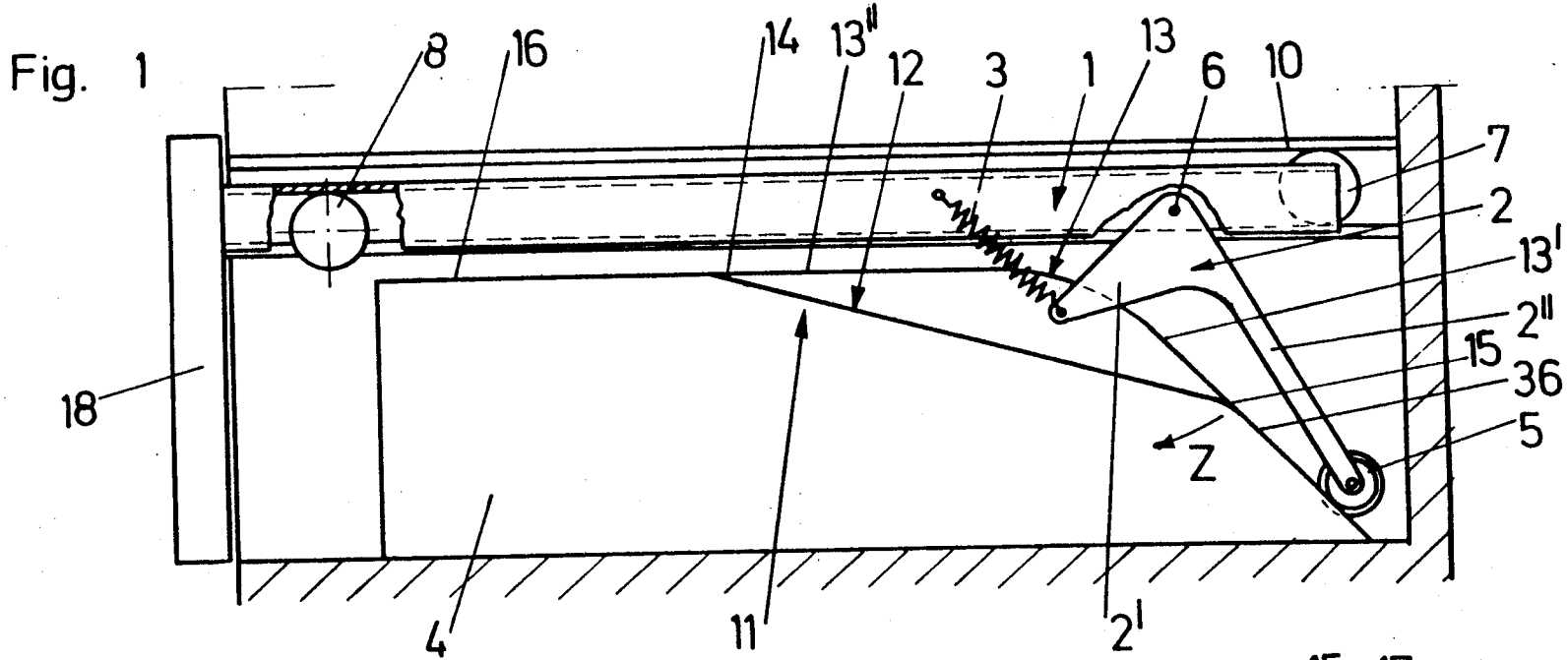
FIG. 1 is a side view of a drawer with a closing device in a closed position of the drawer.

In the embodiment according to FIGS. 1 to 18, a pull-in assembly of a closing device is formed by a two-arm lever 2 on which a roller 5 is mounted. The roller 5 is mounted at an extreme outer end of a lever arm 2'' of the lever, while a spring 3 acts on a lever arm 2' of the lever. The lever 2 is mounted by means of an axle 6 to a pull-out rail 1 of a drawer 18 slidable into and out of a furniture body.

A rear end of pull-out rail 1 is provided with a roller 7 in a manner known per se. The front end of the pull-out rail runs on a roller 8 which is fastened to a side wall 9 of the body or to a supporting rail 10 fastened to the body side wall 9. The roller 7 of the pull-out rail 1 is guided in the supporting rail 10 which has a U-shaped profile.

The closing device also includes a guiding strip 4, having at its top member or a guiding path 11, fastened to the body side wall 9. A center portion of guiding path 11 has two tracks 12, 13. Track 12 has a relatively slight inclination, while track 13 has a steeper portion 13'. Tracks 12 and 13 meet each other at a front junction 14 and at a rear junction 15. A horizontal portion or guiding stretch 16 extends forwardly of the front junction 14. Rearwardly of the junction 15 is a portion 36 which has the same inclination as portion 13' of track 13. Switching portions 17, 19 are provided at the junctions 14 and 15, respectively.

Figure 2:
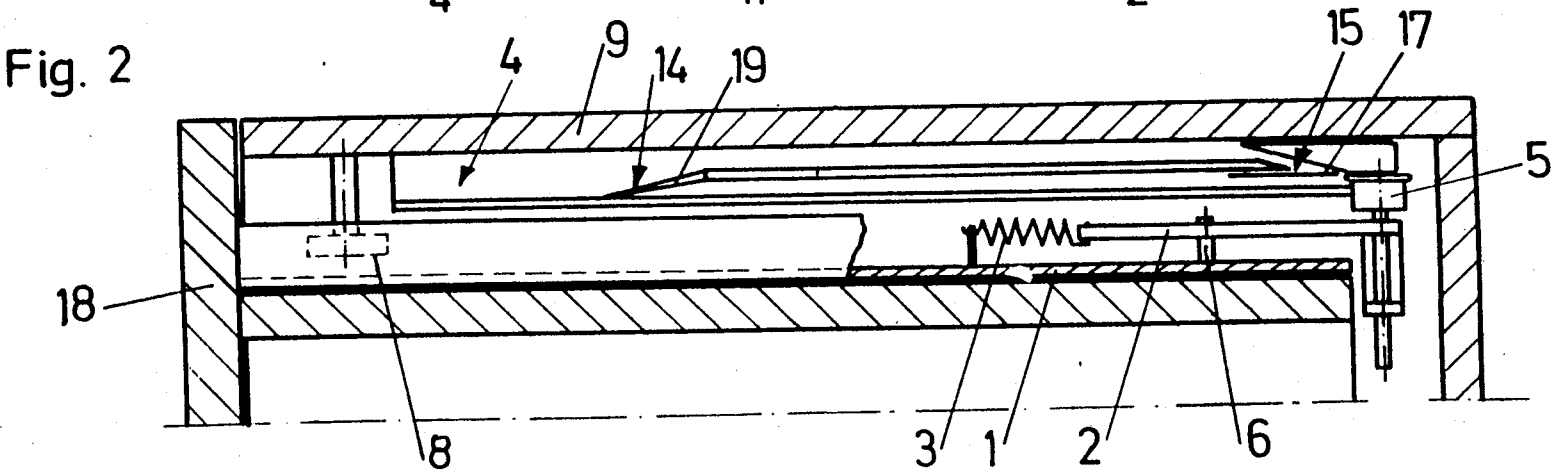
FIG. 2 is a top view of the drawer and the closing device as shown in FIG. 1.
Figure 3:
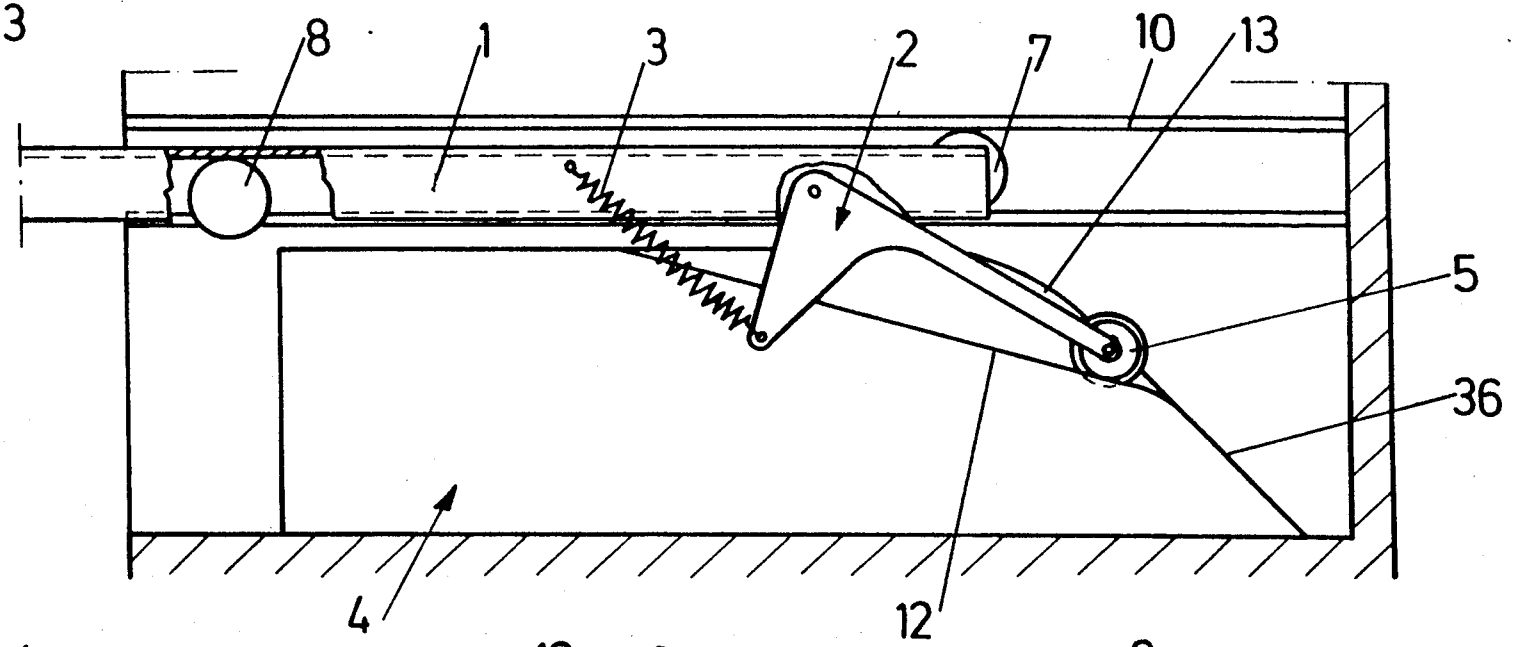
FIG. 3 is a side view of the closing device and the drawer shown in FIGS. 1 and 2, the drawer being shown during extracting movement of the drawer.
Figure 4:
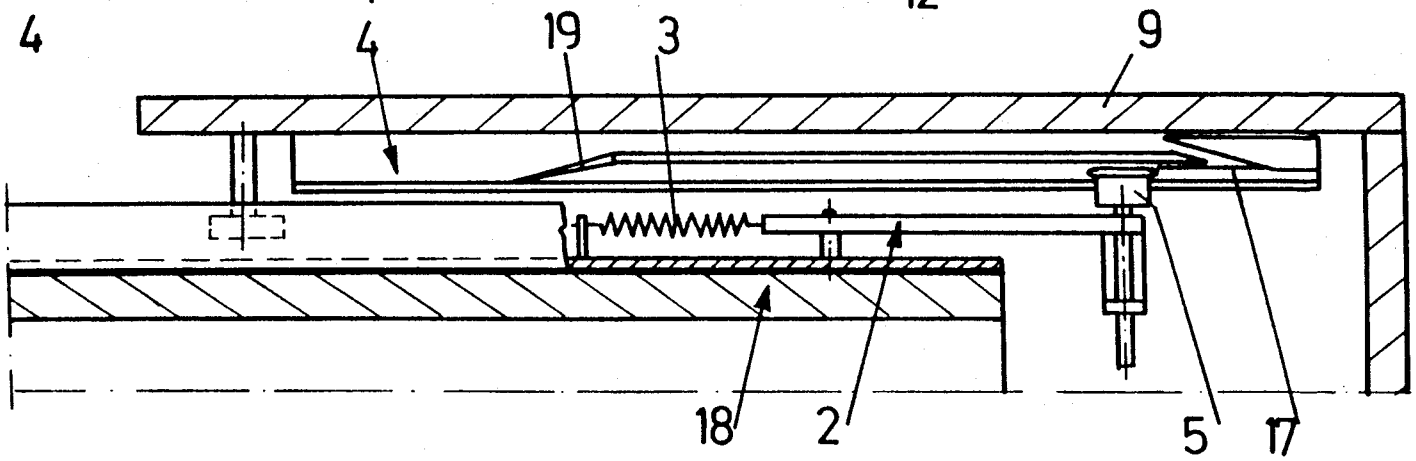
FIG. 4 is a top view of the closing device and the drawer as shown in FIG. 3.
Figure 5:
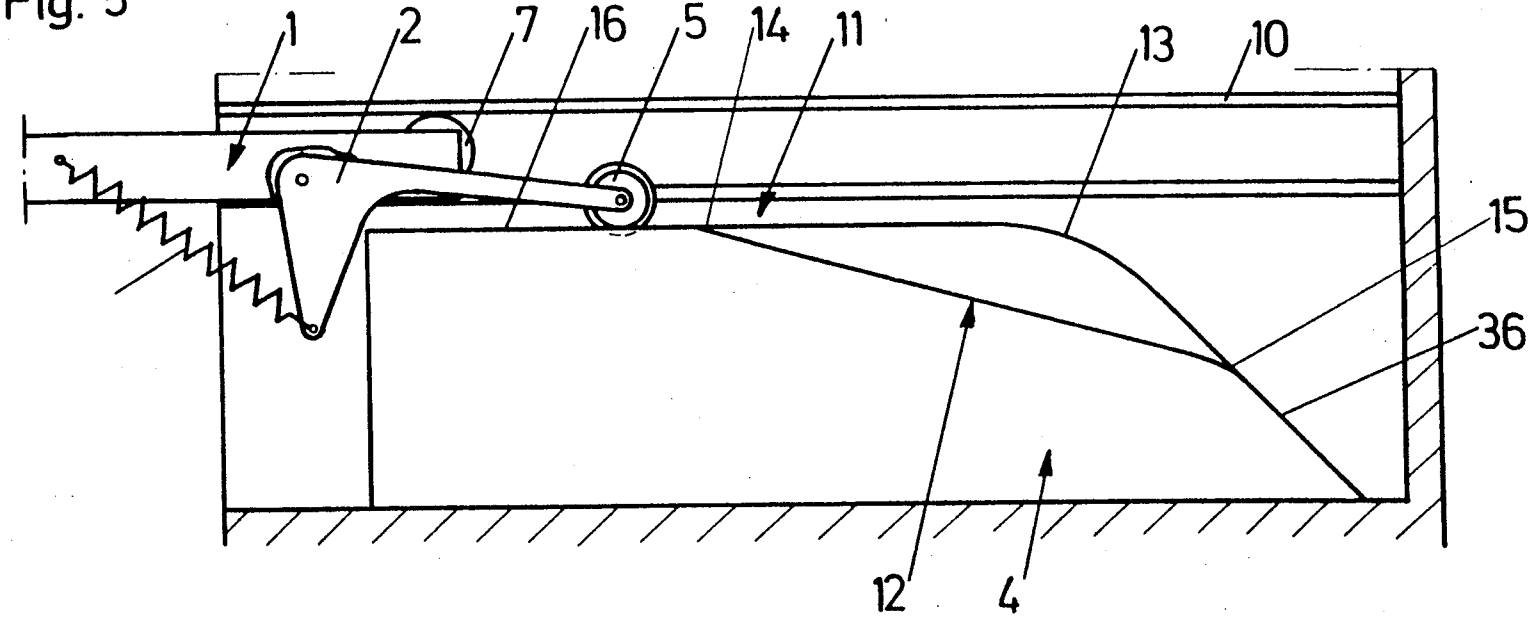
FIG. 5 is a side view of the closing device and the drawer shown in an extracted position.
Figure 6:
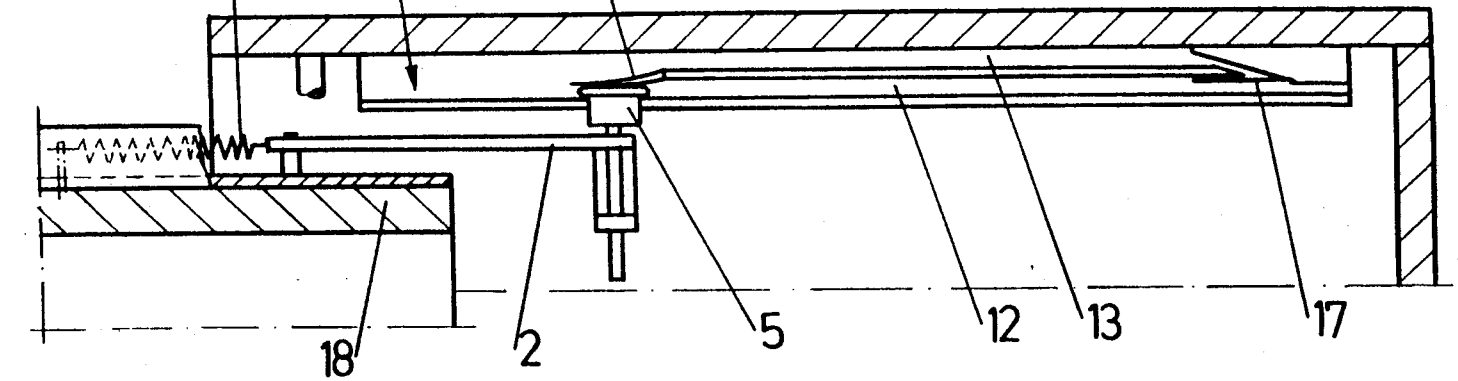
FIG. 6 is a top view of the closing device and the drawer as shown in FIG. 5, wherein a roller is shown just passing a switch.
Figure 7:
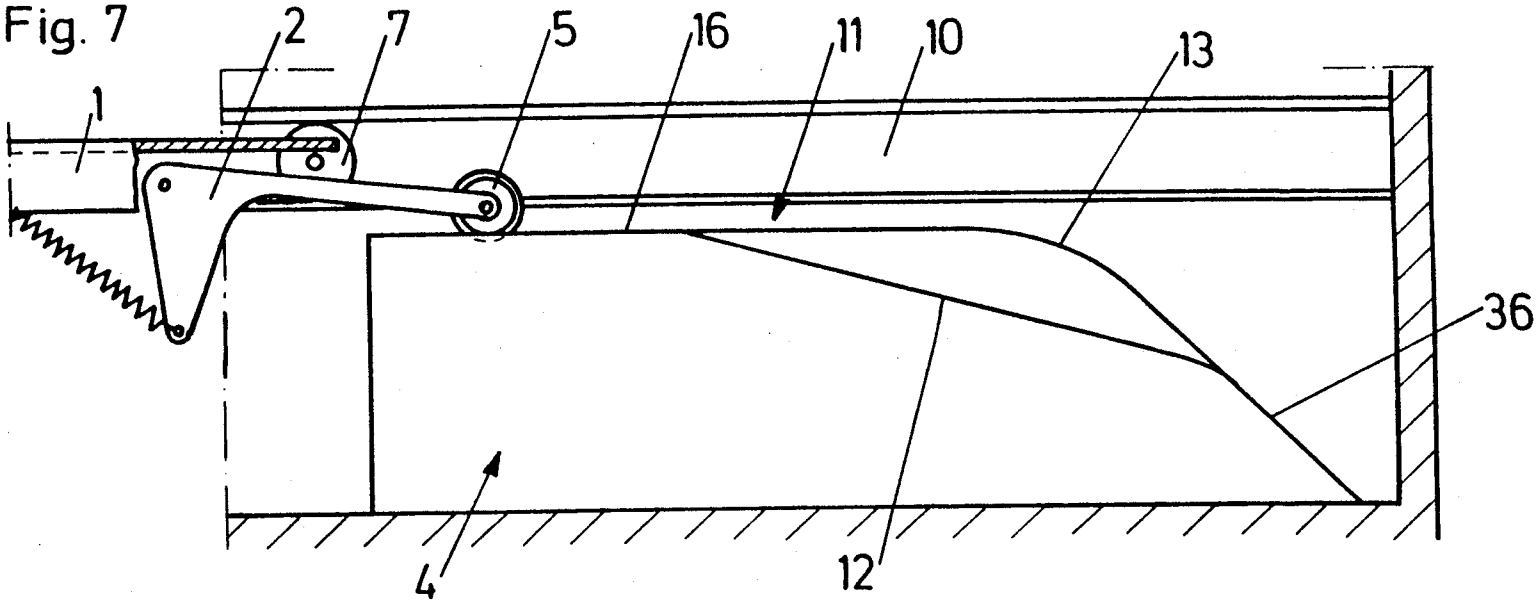
FIG. 7 is a side view of the closing device shown in the extracted position.
Figure 8:
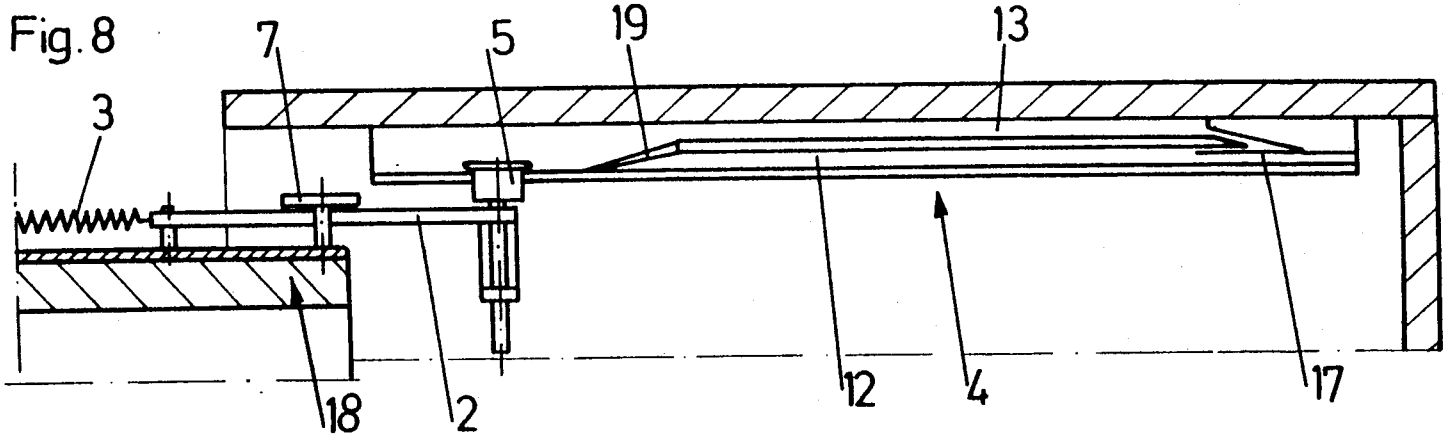
FIG. 8 is a top view of the closing device as shown in FIG. 7.
Figure 9:
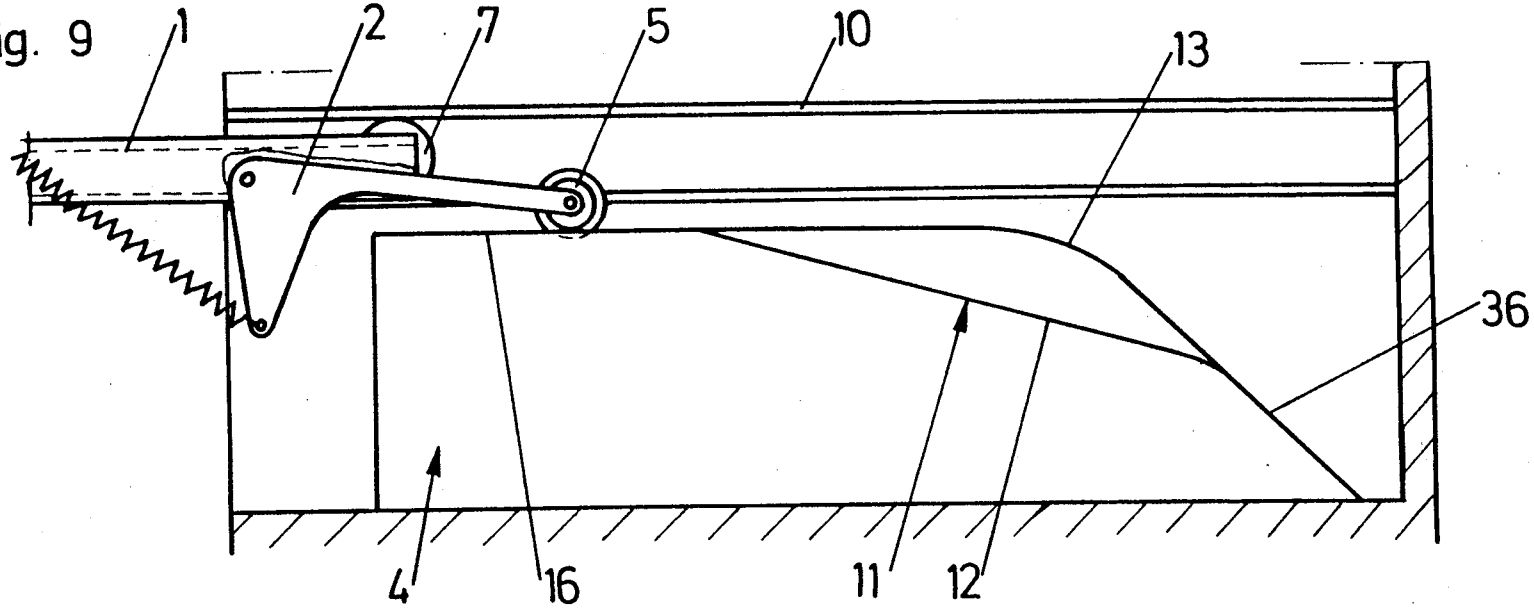
FIG. 9 is a side view of the closing device shown at the beginning of a push-in motion.

In a closed position of the drawer 18, the closing device is in the position shown in FIGS. 1 and 2, i.e. the spring 3 causes lever 2 to press roller 5 against the portion 36. When the drawer 18 is pulled out from the body, the roller 5 moves past the switching portion 17 at the side of the drawer onto the track 12 with a slight inclination (FIG. 3) During such forward movement of the drawer 18, spring 3 is tensioned. However, due to the fact that roller 5 mounts track 12 relatively smoothly, it is possible to pull the drawer 18 out from the furniture body without great force. During such extracting operation, the roller 5 passes the switching portion 19 onto the horizontal guiding stretch 16 (FIG. 5). When the drawer 18 is in the extreme front position, the spring 3 is maximally tensioned. However, spring 3 exerts no force in the closing direction, since roller 5 is, as shown in FIG. 7, positioned on the horizontal guiding stretch 16.

Figure 10:
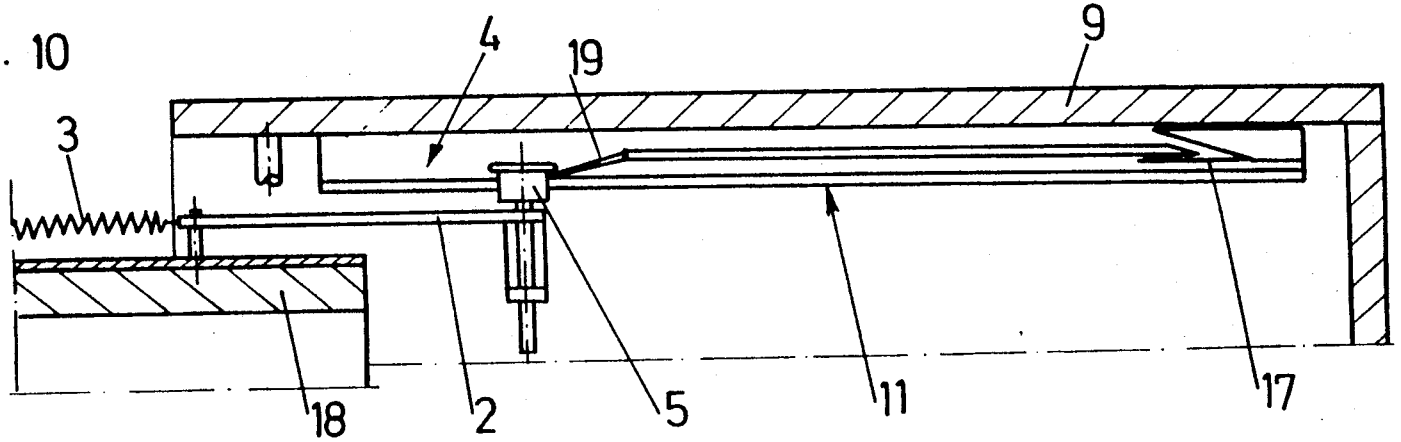
FIG. 10 is a top view of the closing device as shown in FIG. 9.
Figure 11:
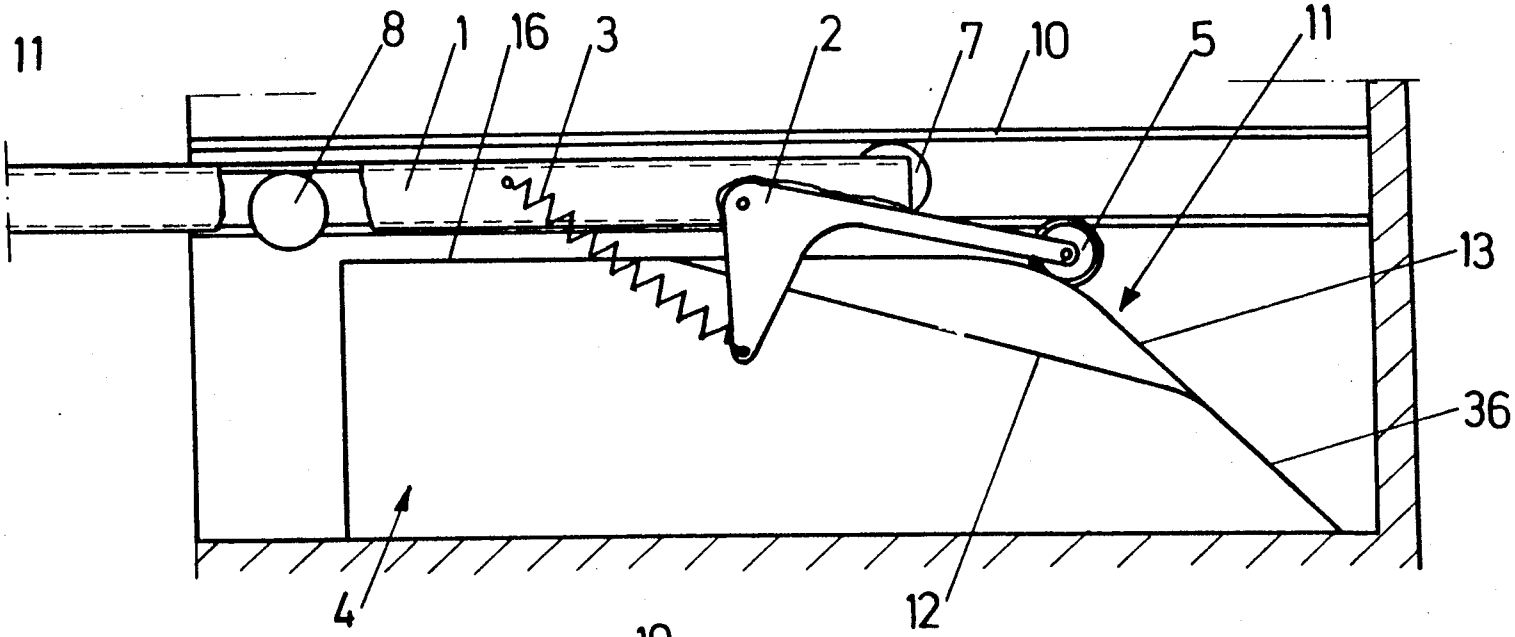
FIG. 11 is a side view of the closing device shown in a position in which it effects an inward motion of the drawer into a furniture body.
Figure 12:
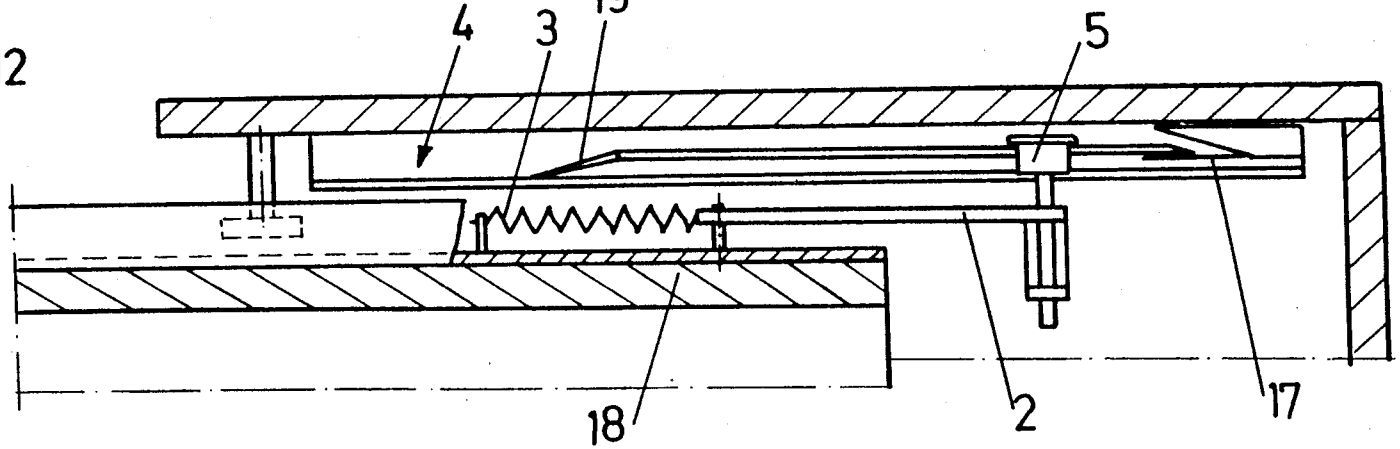
FIG. 12 is a top view of the closing device and drawer as shown in FIG. 11.
Figure 15:
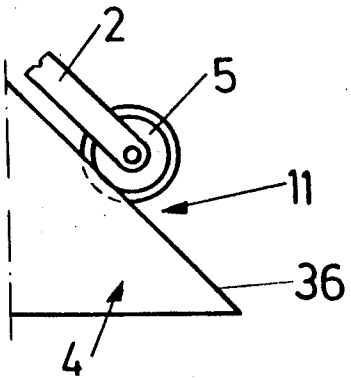
FIG. 15 is a side view of a roller shown in FIG. 13.
Figure 16:
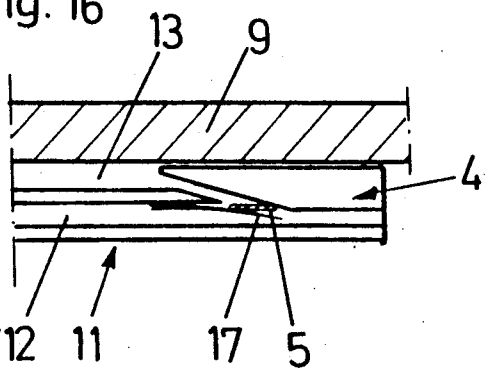
FIG. 16 is an enlarged section of area A of FIG. 14 in which, for the sake of clarity, the roller only is schematically illustrated in association with the drawer.
Figure 13:
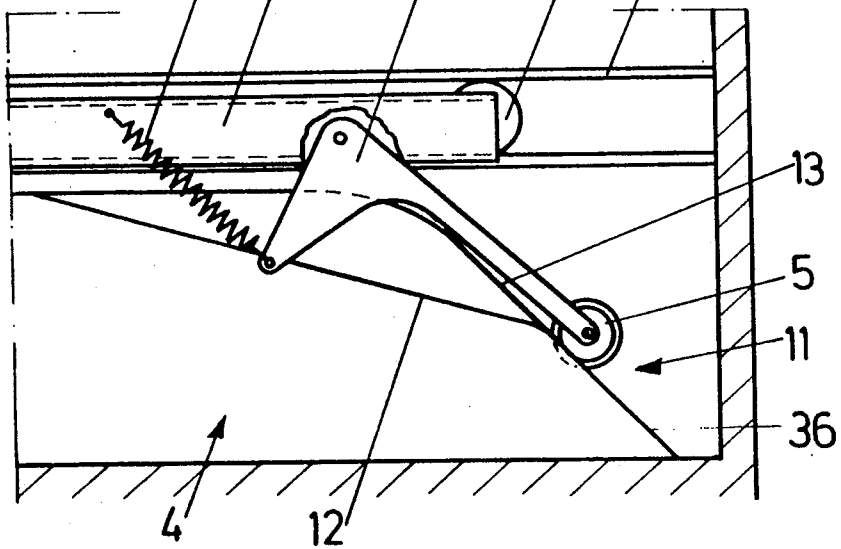
FIG. 13 is a side view of the closing device shown at the end of a push-in motion.
Figure 14:
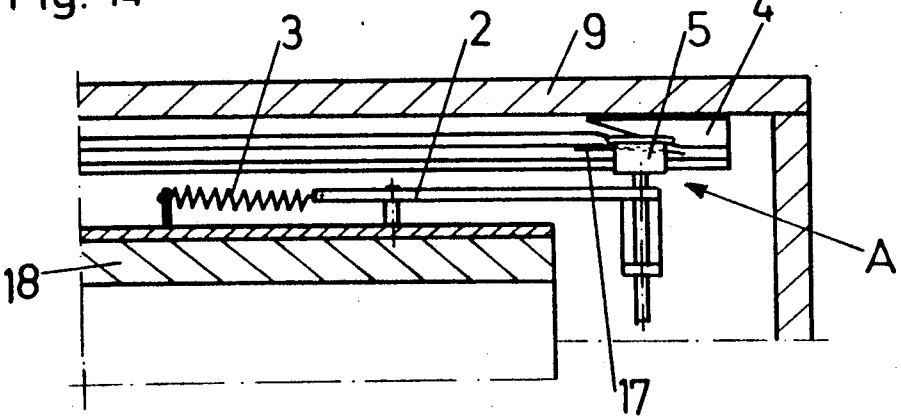
FIG. 14 is a top view of the closing device as shown in FIG. 13.
Figure 17:
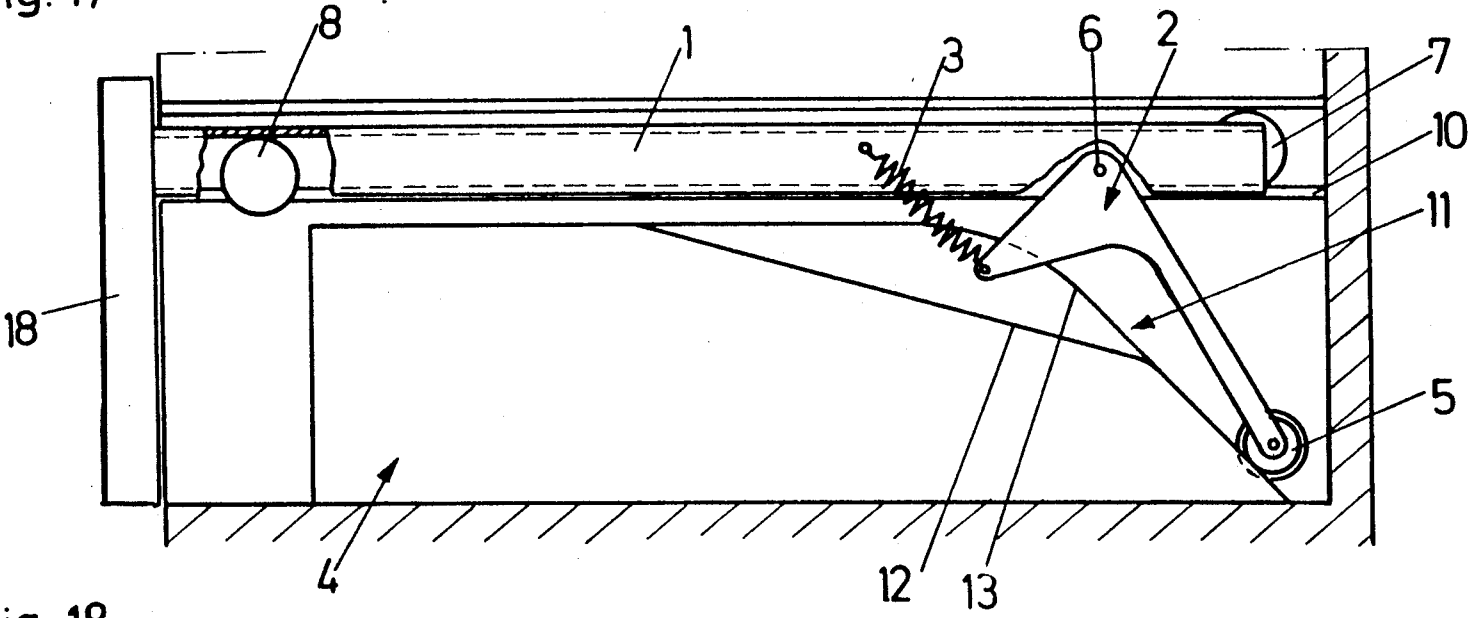
FIG. 17 is a side view of the closing device, the drawer being shown in the closed position.
Figure 18:
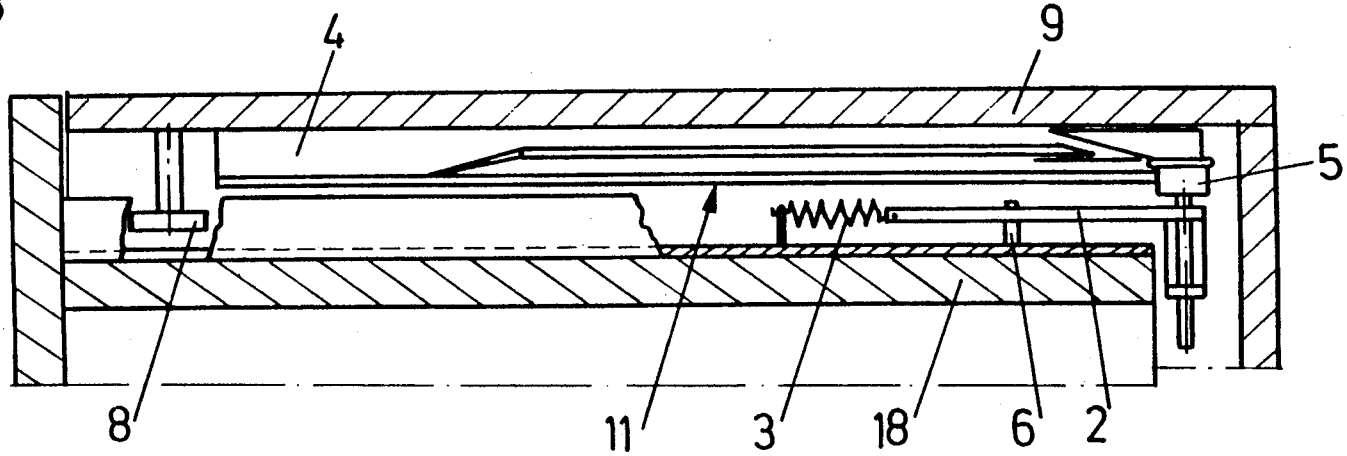
FIG. 18 is a top view of the closing device and the drawer as shown in FIG. 17.

When the drawer 18 is pushed in, roller 5 is, as particularly shown in FIG. 10, moved past switching portion 19 laterally away from the drawer 18. Roller 5 thus moves onto track 13. No closing forces are exerted by the spring 3 until the drawer 18 is located substantially in the rear third of the push-in path, since a front portion 13'' of track 13 as well as the guiding stretch 16 extend substantially horizontally At the moment when roller 5 reaches track portion 13' (see FIG. 11) the closing force of spring 3 becomes effective. Due to the force of spring 3 roller 5 then is pressed onto track portion 13' and thus obliquely downward. The drawer 18 thereby is pulled into the furniture body until the roller 5 moves past the switching portion 17 and abuts again on the portion 36 as in the initial position (FIGS. 17, 18). The switching portion 17 guarantees that, when the drawer 18 is again pulled out from the furniture body, roller 5 moves again onto track 12.

Figure 19:
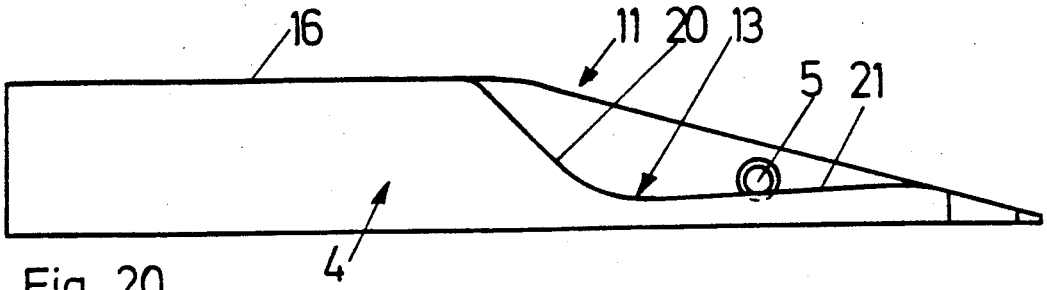
FIG. 19 is a side view of a further embodiment of a guide member or path.
Figure 20:
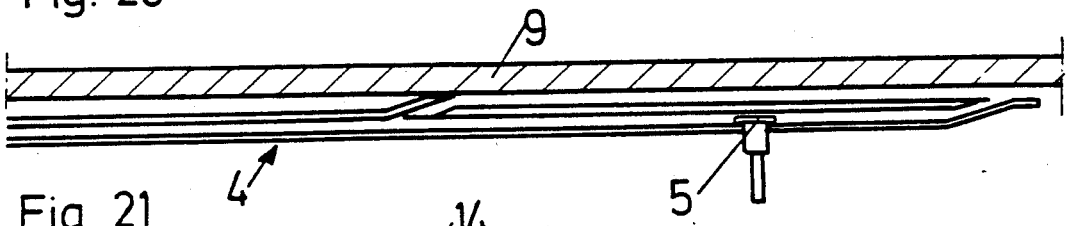
FIG. 20 is a top view of the guide path as shown in FIG. 19.
Figure 21:
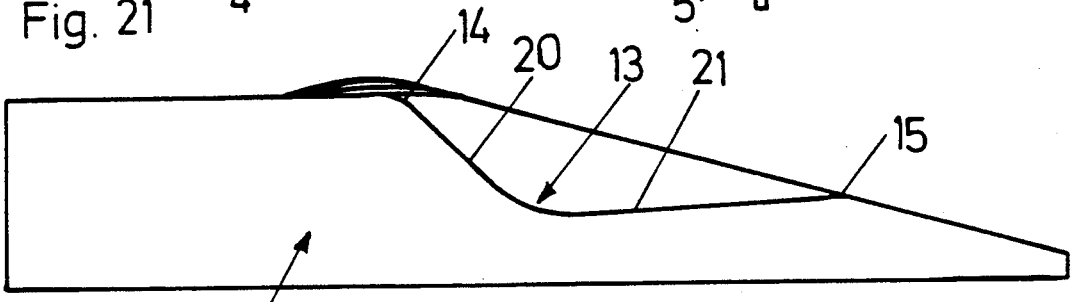
FIG. 21 is again a side view of a path according to the invention.
Figure 23:
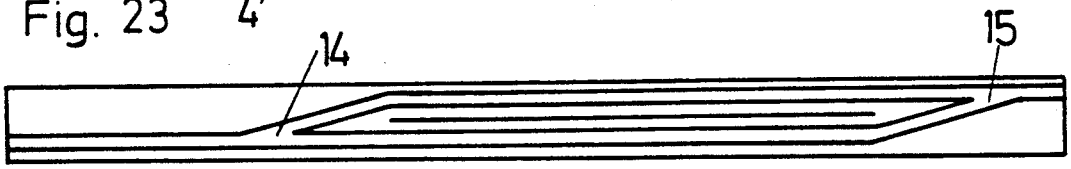
FIG. 23 is a top view of the path shown in FIG. 21.
Figure 22:
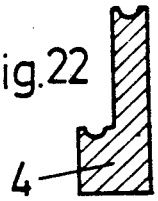
FIG. 22 is a cross-section of the path shown in FIG. 21.
Figure 24:
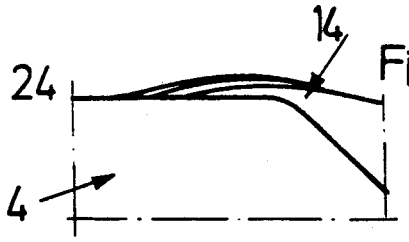
FIGS. 24 to 27 are various views of track junctions.
Figure 25:
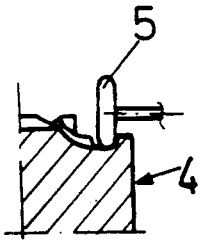
Figure 26:
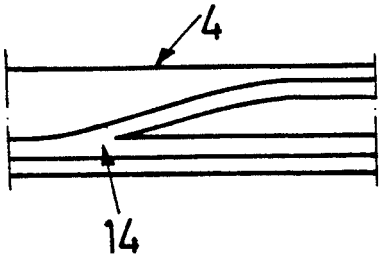
Figure 27:
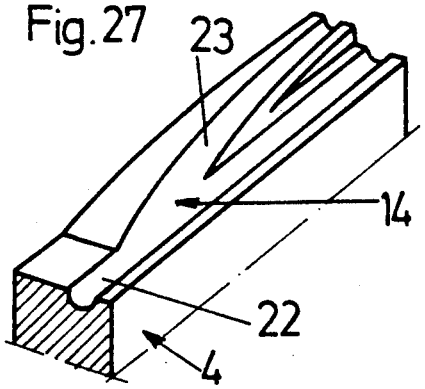

In the embodiment according to FIGS. 19 ad 20, track 13, which in this arrangement is positioned closer to the drawer 18, has an inclined portion 20 at its front end. As a result, during its inward motion the drawer is accelerated sooner, and the effect of inertia from such acceleration is utilized to continue moving the drawer rearwardly to overcome the unaccelerated residual distance of a portion 21. Portion 21 is relatively flat but is slightly oppositely inclined and adjoins the inclined portion 20. Since portion 21 is slightly oppositely inclined towards the rear, the final rearward movement of drawer 18 will be slowed down. By means of the above-described embodiment, the obtainable range of automatic inward movement is increased, on the one hand, and on the other hand a harmonious inward motion of the drawer with very little closing noise can be obtained. These advantages are achieved by adapting the inclinations of the track portions 20, 21 to the rolling and mounting friction of roller 5 as well as to the force of spring 3.

FIGS. 21 to 27 show an advantageous embodiment of the track junctions. In this arrangement, the roller 5 is guided in track 22. With a suitable design of the junctions 14, 15 the roller pressure on the guiding path is utilized together with an inclination of a path flank 23 in a transition region for tracking the roller when the drawer 18 is being pushed in or extracted. In this arrangement there is no need for a movable switching portion.

Figure 30:
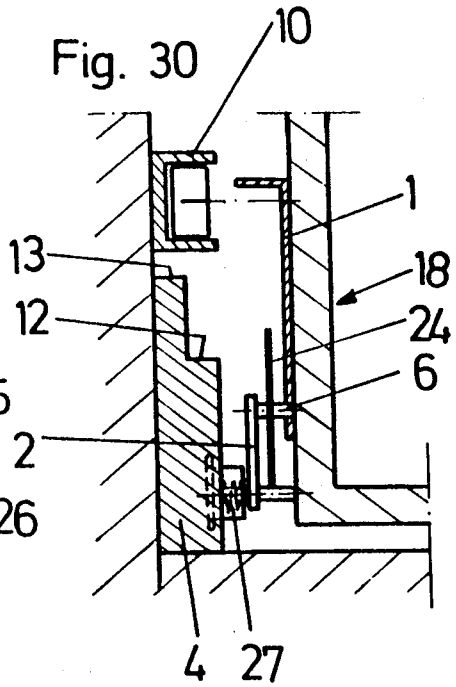
FIG. 30 is a vertical sectional view of the closing device shown in FIG. 28.
Figure 28:
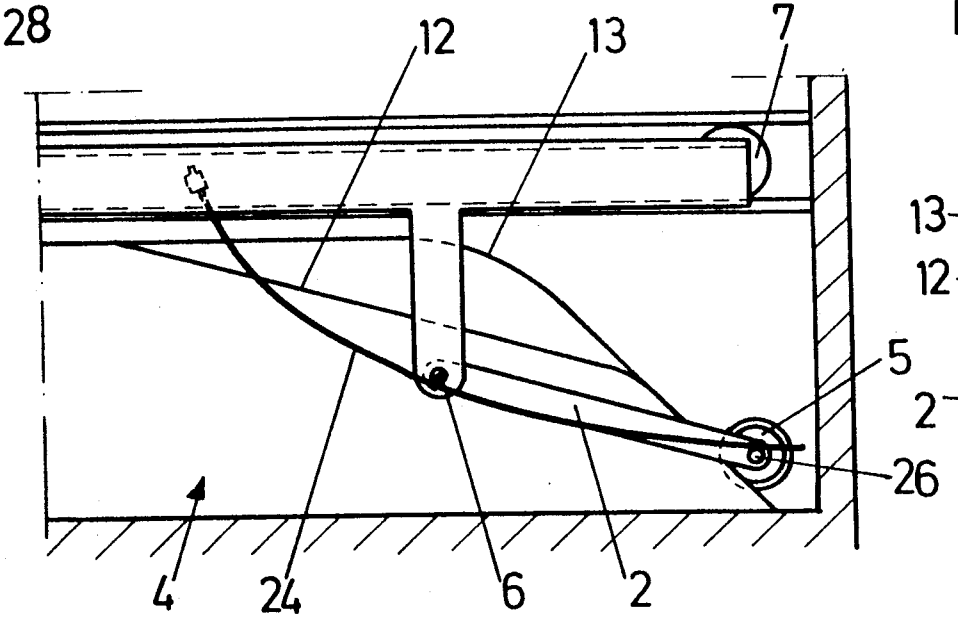
FIG. 28 is a side view of a further embodiment of the closing device according to the invention.
Figure 29:
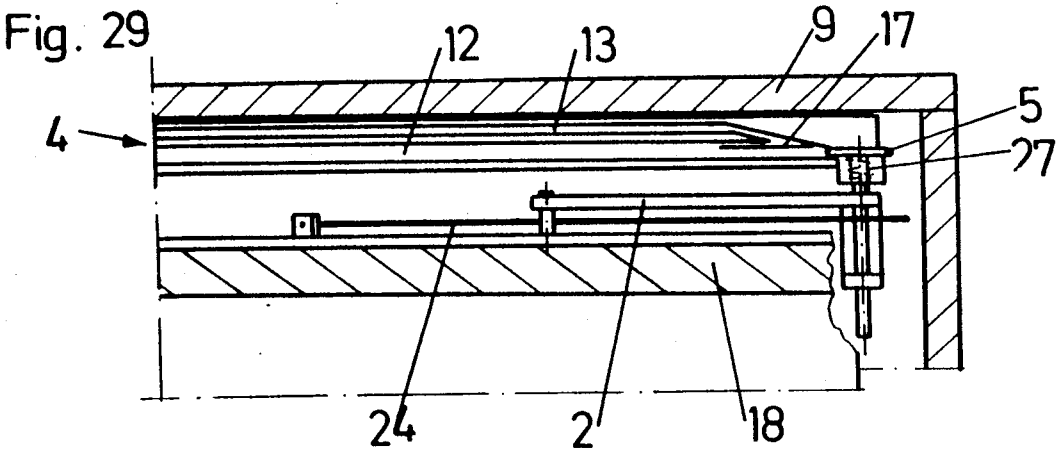
FIG. 29 is a top view of the closing device as shown in FIG. 28.

In the embodiment according to FIGS. 28 to 30, the spring 3 is replaced by a leaf spring 24. The leaf spring 24 is mounted on the pull-out rail 1 and abuts on the axle 6 of the lever 2 as well as on an axis 26 of the roller 5. The lever 2 in this embodiment is a one-arm lever. The function of this embodiment is completely the same as the function of the afore-described embodiment. When the drawer 18 is extracted the spring 24 is tensioned, and when the drawer 18 is pushed in the potential energy of the spring 24 is utilized to pull the drawer 18 into the furniture body. In this embodiment, the roller 5 is pushed in an axial direction toward the body side walls by a spring 27, that is to the edge of the guiding strip 4 whereby correct track guiding is guaranteed.

What is claimed is:

1. A closing device, for use with a drawer that is movable in opposite directions with respect to an article of furniture between open and closed positions, to ensure that, upon the drawer being moved toward the closed position, the drawer is moved to and maintained at the closed position, said closing device comprising:

a guide member to be mounted on a side wall of a body of the article of furniture, said guide member having a guide path defined over a portion of the length thereof by a double-track portion including first and second tracks;

a pull-in assembly to be mounted on the drawer and operable, when the drawer is moved at least partially in a direction to the closed position, in cooperation with said guide member to move the drawer over a final portion of the movement thereof to the closed position, said pull-in assembly comprising a member mounted on a pivotable lever and acted on by a spring to be urged under pressure against said guide path; and said member being guided along said first track during movement of the drawer from the closed position to the open position, and said member being guided along said second track during movement of the drawer from the open position to the closed position.

2. A device as claimed in claim 1, wherein said member comprises a roller.

3. A device as claimed in claim 1, wherein at least portions of said first and second tracks are inclined upwardly in a direction to be directed toward the front of the drawer.

4. A device as claimed inn claim 3, wherein the inclination of said portion of said second track is greater than that of said first track.

5. A device as claimed in claim 3, wherein said second track has another inclined portion adjoining rearwardly said upwardly inclined portion thereof.

6. A device as claimed in claim 5, wherein the inclination of said another inclined portion is less than the inclination of said upwardly inclined portion.

7. A device as claimed in claim 5, wherein said another inclined portion is inclined in a direction opposite to said direction of inclination of said upwardly inclined portion.

8. A device as claimed in claim 1, further comprising switching means between at least first adjacent ends of said first and second tracks.

9. A device as claimed in claim 8, comprising said switching means between both adjacent first ends and adjacent second ends of said first and second tracks.

10. A device as claimed in claim 8, wherein said switching means comprise an elastic member.

11. A device as claimed in claim 1, wherein said guide path further includes a substantially horizontal single-track portion adjoining said double track portion and extending therefrom in a direction to be directed toward the front of the drawer.

12. A device as claimed in claim 11, wherein said guide path further includes an inclined single-track portion adjoining said double-track portion and extending therefrom in a direction to be directed toward the rear of the drawer.

13. A device as claimed in claim 12, wherein the inclination of said single-track portion is the same as an inclination of a portion of said second track.

14. A device as claimed in claim 12, wherein the inclination of said single-track portion is the same as an inclination of said first track.

15. A device as claimed in claim 1, wherein said first and second tracks are on different levels of said guide member.

16. A device as claimed in claim 1, wherein said lever comprises a two-arm lever, said member is mounted on a first arm of said lever, and said spring acts on a second arm of said lever.

17. A device as claimed in claim 16, wherein said spring comprises a compression spring.

18. A device as claimed in claim 1, wherein said lever comprises a one-arm lever, and said spring comprises a leaf spring.

19. A device as claimed in claim 1, further comprising another spring urging said member in a direction to be laterally outwardly of the drawer toward the body side wall.

20. A device as claimed in claim 19, wherein said member comprises a roller and said another spring urges said roller axially thereof.

21. In an assembly including a drawer movable in opposite directions into and out of an article of furniture between closed and open positions, and a closing device to ensure that, upon said drawer being moved toward said closed position, said drawer is moved to and maintained at said closed position, the improvement wherein said closing device comprises:

a guide member mounted on a side wall of a body of said article of furniture, said guide member having a guide path defined over a portion of the length thereof by a double-track portion including first and second tracks;

a pull-in assembly mounted on said drawer and operable, when said drawer is moved at least partially in a direction to said closed position, in cooperation with said guide member to move said drawer over a final portion of the movement thereof to said closed position, said pull-in assembly comprising a member mounted on a pivotable lever and acted on by a spring and urged thereby under pressure against said guide path; and said member being guided along said first track during movement of said drawer from said closed position to said open position, and said member being guided along said second track during movement of said drawer from said open position to said closed position.

22. The improvement claimed in claim 21, wherein said member comprises a roller.

23. The improvement claimed in claim 21, wherein at least portions of said first and second tracks are inclined upwardly in a direction toward the front of said drawer.

24. The improvement claimed in claim 23, wherein the inclination of said portion of said second track is greater than that of said first track.

25. The improvement claimed in claim 23, wherein said second track has another inclined portion adjoining rearwardly said upwardly inclined portion thereof.

26. The improvement claimed in claim 25, wherein the inclination of said another inclined portion is less than the inclination of said upwardly inclined portion.

27. The improvement claimed in claim 25, wherein said another inclined portion is inclined in a direction opposite to said direction of inclination of said upwardly inclined portion.

28. The improvement claimed in claim 21, further comprising switching means between at least first adjacent ends of said first and second tracks.

29. The improvement claimed in claim 28, comprising said switching means between both adjacent first ends and adjacent second ends of said first and second tracks.

30. The improvement claimed in claim 28, wherein said switching means comprise an elastic member.

31. The improvement claimed in claim 21, wherein said guide path includes a substantially horizontal single-track portion adjoining said double track portion and extending therefrom in a direction directed toward the front of said drawer.

32. The improvement claimed in claim 31, wherein said guide path further includes an inclined single-track portion adjoining said double-track portion and extending therefrom in a direction directed toward the rear of said drawer.

33. The improvement claimed in claim 32, wherein the inclination of said single-track portion is the same as an inclination of a portion of said second track.

34. The improvement claimed in claim 32, wherein the inclination of said single-track portion is the same as an inclination of said first track.

35. The improvement claimed in claim 21, wherein said first and second tracks are on different levels of said guide member.

36. The improvement claimed in claim 21, wherein said lever comprises a two-arm lever, said member is mounted on first arm of said lever, and said spring acts on a second arm of said lever.

37. The improvement claimed in claim 36, wherein said spring comprises a compression spring.

38. The improvement claimed in claim 21, wherein said lever comprises a one-arm lever, and said spring comprises a leaf spring.

39. The improvement claimed in claim 21, further comprising another spring urging said member in a direction laterally outwardly of said drawer toward said body side wall.

40. The improvement claimed in claim 39, wherein said member comprises roller and said another spring urges said roller axially thereof.

41. The improvement claimed in claim 21, comprising a respective said closing device at each of opposite sides of said drawer.

* * * * *